United States Patent [19]

Mader

[11] 4,063,740

[45] Dec. 20, 1977

[54] CAP ATTACHMENT DEVICE FOR GOLF TRAINING

[76] Inventor: Robert J. Mader, 1218 Arlington Ave., Torrance, Calif. 90501

[21] Appl. No.: 751,688

[22] Filed: Dec. 17, 1976

[51] Int. Cl.[2] ..... A63B 69/36

[52] U.S. Cl. ..... 273/183 B; 273/183 E; 2/433; 2/185 R

[58] Field of Search ..... 273/183 B, 183 E, 190 A; 2/185 R, 12, 10, 433

[56] References Cited

U.S. PATENT DOCUMENTS

| | | | |
|---|---|---|---|
| 399,892 | 3/1889 | Harrison | 2/12 |
| 825,288 | 7/1906 | Ash | 2/185 R |
| 1,857,284 | 5/1932 | Nelson | 2/12 X |
| 2,728,078 | 12/1955 | Taylor | 2/433 |
| 3,826,502 | 7/1974 | Sorge | 273/183 B |

*Primary Examiner*—George J. Marlo
*Attorney, Agent, or Firm*—Edward A. Sokolski

[57] ABSTRACT

A flat piece of material such as of plastic or cardboard has bent-over tabs along the top edge thereof. An aperture is formed in the material directly below each tab, a clip member being fitted through each of these apertures being used to removably attach the tabs to the brim of a golfing cap or visor, the material being bent around to conform to the curvature of the brim. A viewing aperture is formed in the material spaced substantially equally from the side edges thereof, and at a distance down from the top edge which corresponds approximately to the eye level of the wearer of a cap with the device attached thereto. The device provides a golfer with a peephole to the ball which is helpful in training him to keep his eye on the ball throughout his swing.

5 Claims, 4 Drawing Figures

CAP ATTACHMENT DEVICE FOR GOLF TRAINING

This invention relates to golf training aids and more particularly to such a device which attaches to the brim of a golfer's hat and provides a line of sight to the golf ball.

One of the most difficult things for a golfer to learn is to keep his eye on the ball throughout his swing and not to turn his head upwardly. While this is essential for good golfing, there are few good training devices available to aid the golfer in learning this technique.

The device of the present invention is a simple highly economical yet effective aid for training one to keep his eye on the ball throughout the golf swing.

It is therefore an object of this invention to facilitate the learning of the golf swing.

It is a further object of this invention to provide a highly economical device which is useful for teaching a golfer to keep his eye on the ball throughout his golf swing.

It is still another object of this invention to provide a device for teaching the golf swing which can be removably attached to the brim of a golfer's cap or visor.

Other objects of this invention will become apparent as the description proceeds in connection with the accompanying drawings, of which:

Figure 1:
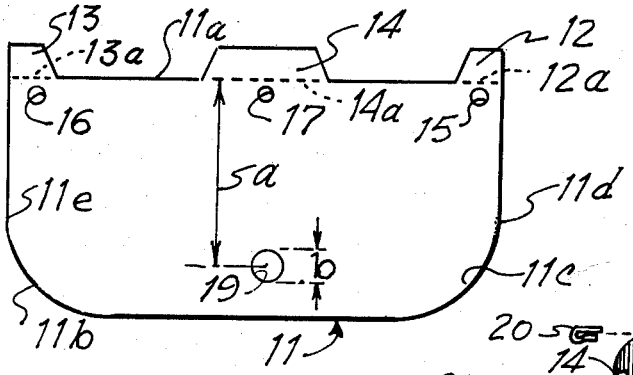
FIG. 1 is a plan view of a preferred embodiment of the invention prior to its installation on a golf cap.

Referring now to FIG 1, a preferred embodiment of the device of the invention is illustrated prior to its installation on the brim of a golf cap or visor. The device is formed of a flat piece of relatively thin flexible material 11, such as of cardboard or plastic. The device has a pair of end tabs 12 and 13 and a central tab 14 which extend from the top edge 11*a* thereof. Crease lines 12*a*–*14a* are formed along the inner edges of tabs 12–14 to facilitate the bending over of the tabs at right angles to the main surfaces of the device. Directly below each of tabs 12–14 is an aperture 15–17 respectively. The bottom corner portions 11*b* and 11*c* of the device are rounded. Spaced substantially equally from the side edges 11*d* and 11*e* of the device and down a distance "*a*" (as indicated in the Figure) is a peephole aperture 19. This aperture is spaced at a distance "*a*" which typically is 3¾ inches and has a diameter "*b*" (as indicated in the Figure) which is typically 9/16 inches, these dimensions being chosen so the peephole is at the eye level of the average user and is adequate to provide a narrow line of sight to the golf ball so the user will be immediately aware of when he starts to move his head during the golf swing.

Figure 2:
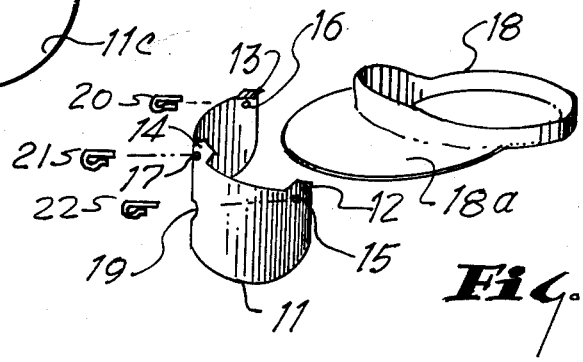
FIG. 2 is an exploded perspective view showing the installation of the preferred embodiment on the brim of a golf visor.

Referring now to FIG. 2, the installation of the device of the invention on the brim of a golf visor is illustrated. In installing the device 11 on the brim 18*a* of visor 18, tabs 12– are first bent over as shown in the Figure. Clips 20–22 are then placed through apertures 16, 17 and 15 respectively and then clipped to brim 18 so as to clamp the training device 11 to the brim.

Figure 3:
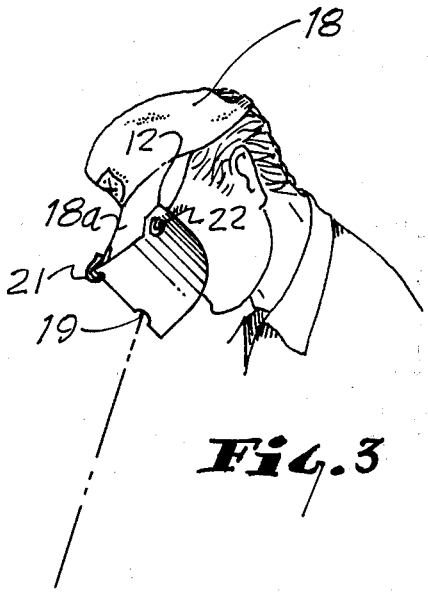
FIG. 3 is a side elevational view showing a golfer wearing a visor having the device of the invention installed thereon.

FIG. 3 shows the device of the invention 11 installed on the brim 18*a* of visor 18 with the visor being worn.

Figure 4:
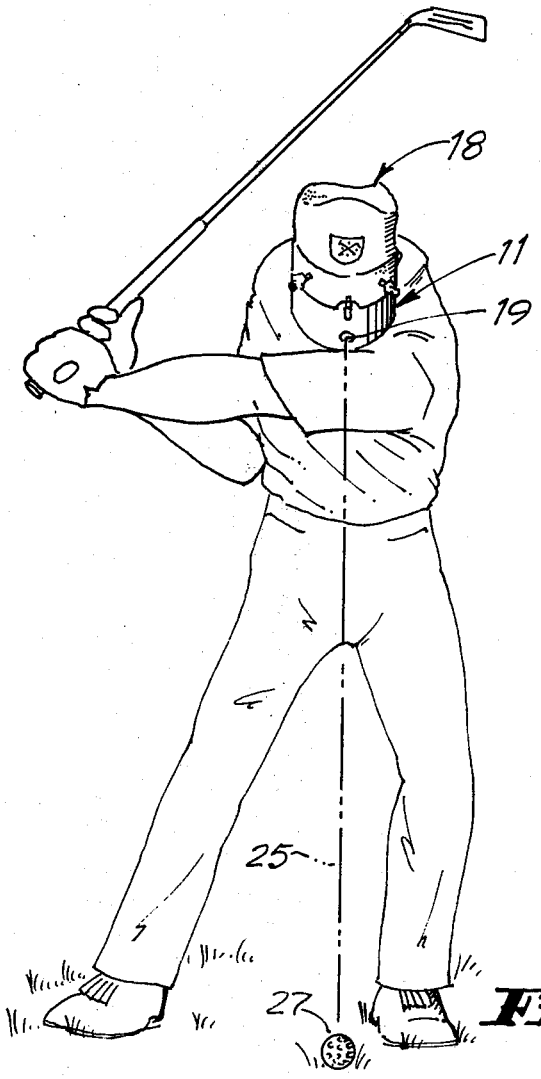
FIG. 4 is a view showing a golfer utilizing the device of the invention.

FIG. 4 shows the device of the invention in use by a golfer.

As can be seen in FIG. 4, the device of the invention provides a narrow line of sight 25 between the golfer's eyes and golf ball 27 through peephole 19. Should the golfer move his head even slightly, he will lose sight of the ball, immediately bringing this condition to his attention. It is to be noted in this vein that when a golfer starts to move his head, in view of the fact that he still will be able to see the ball (when not using the device of the invention), he will not be aware of this fact. The device of the invention thus immediately brings to the golfer's attention such head movements so that he can correct the situation more readily.

While the invention has been described and illustrated in detail, it is to be clearly understood that this is intended by way of illustration and example only and is not to be taken by way of limitation, the spirit and scope of this invention being limited only by the terms of the following claims.

I CLAIM:

1. A golf training device which attaches to the brim of a cap or the like for use in training a golfer to keep the eyes on the ball throughout the golf swing, comprising:

a thin flexible sheet having a plurality of tabs formed along the top edge thereof, an aperture formed in said sheet directly below each of said tabs, and a peephole aperture formed in said sheet at a position thereon spaced substantially equally from the side edges of said sheet and a predetermined distance from said top edge of said sheet, to provide a peephole through said sheet for the user of said device, and clip means for removably attaching said device to the brim of said cap, said clip means comprising a clip which is fitted through each of the apertures directly below the tabs and retaining said tabs in abutment against the brim of the cap.

2. The device of claim 1 wherein there are three of said tabs, two of said tabs being located at the opposite ends of the top edge of said sheet, the third of said tabs being located at the center of the top edge of said sheet.

3. The device of claim 2 wherein the peephole aperture is spaced from the top edge of said sheet a distance which corresponds to the eye level of the user of the device.

4. The device of claim 3 wherein the bottom corners of said sheet are rounded.

5. The device of claim 3 wherein the distance of said peephole aperture from the top edge of said sheet is approximately 3¾ inches and the diameter of said peephole aperture is approximately 9/16 inches.

* * * * *